US011041245B2

(12) United States Patent
Miyasaka

(10) Patent No.: US 11,041,245 B2
(45) Date of Patent: Jun. 22, 2021

(54) METHOD FOR PREVENTING ADHESION OF ALUMINUM

(71) Applicant: FUJI KIHAN CO., LTD., Nagoya (JP)

(72) Inventor: Yoshio Miyasaka, Nagoya (JP)

(73) Assignee: FUJI KIHAN CO., LTD., Nagoya (JP)

( * ) Notice: Subject to any disclaimer, the term of this patent is extended or adjusted under 35 U.S.C. 154(b) by 0 days.

(21) Appl. No.: 16/085,256

(22) PCT Filed: Feb. 1, 2017

(86) PCT No.: PCT/JP2017/003608
§ 371 (c)(1),
(2) Date: Sep. 14, 2018

(87) PCT Pub. No.: WO2017/199476
PCT Pub. Date: Nov. 23, 2017

(65) Prior Publication Data

US 2019/0085464 A1 Mar. 21, 2019

(30) Foreign Application Priority Data

May 20, 2016 (JP) ..... JP2016-101659

(51) Int. Cl.
*C23C 24/04* (2006.01)
*B24C 1/10* (2006.01)
*C23C 28/04* (2006.01)

(52) U.S. Cl.
CPC ..... *C23C 24/04* (2013.01); *B24C 1/10* (2013.01); *C23C 28/04* (2013.01)

(58) Field of Classification Search
CPC ..... C23C 24/04
See application file for complete search history.

(56) References Cited

U.S. PATENT DOCUMENTS 6,881,475 B2 4/2005 Ohtani et al.
8,410,029 B2 4/2013 Miyasaka
(Continued)

FOREIGN PATENT DOCUMENTS

CN 1390667 A 1/2003
CN 1822928 A 8/2006
(Continued)

OTHER PUBLICATIONS

English translation of DLC Tools to Implement Dry Processing of Aluminum, 2001.*

(Continued)

*Primary Examiner* — Alex A Rolland
(74) *Attorney, Agent, or Firm* — Cooper Legal Group, LLC; Ronald M. Kachmarik

(57) ABSTRACT

A method for preventing adhesion of aluminum onto the surface of a metallic product, which can be performed by a simple treatment, at low cost and within a short time. Tin granules having an average particle diameter of 10 to 100 μm and each having an oxide film formed thereon are sprayed onto the surface of a metallic product under a spraying pressure of 0.5 MPa or more or at a spraying velocity of 200 m/sec or more to form a tin oxide coating film at a thickness of 1 μm or less on a portion of the surface of the metallic product, wherein the portion of the surface of the metallic product is a portion at which the metallic product is in contact with aluminum or an aluminum alloy. By forming the tin oxide coating film, it becomes possible to prevent the adhesion of aluminum onto a metallic product.

8 Claims, 1 Drawing Sheet

(A)

before pre-treatment
(salt bath soft-nitriding)

(B)

after pre-treatment

(56) References Cited

U.S. PATENT DOCUMENTS

| | | | | |
|---|---|---|---|---|
| 9,062,769 | B2 | 6/2015 | Sasaki et al. | |
| 2006/0275543 | A1* | 12/2006 | Miyasaka | C23C 24/04 427/180 |
| 2009/0312206 | A1 | 12/2009 | Miyasaka | |

FOREIGN PATENT DOCUMENTS

| | | | | |
|---|---|---|---|---|
| CN | 101603175 | A | 12/2009 | |
| CN | 103397221 | A | 11/2013 | |
| CN | 104276849 | A | 1/2015 | |
| JP | 2005-54237 | A | 3/2005 | |
| JP | 2005054237 | A | 3/2005 | |
| JP | 2009-176672 | | 8/2009 | |
| JP | 2009-270176 | | 11/2009 | |
| JP | 2009270176 | A | 11/2009 | |
| JP | 2010-48193 | | 3/2010 | |
| JP | 2010048193 | A | 3/2010 | |
| JP | 2013-163187 | | 8/2013 | |
| WO | WO-2005005110 | A1 * | 1/2005 | B26B 19/384 |
| WO | 2011-071049 | A1 | 6/2011 | |

OTHER PUBLICATIONS

Corresponding International Application No. PCT/JP2017/003608 International Search Report dated Mar. 7, 2017, 4 pages.

"DLC Tools to Implement Dry Processing of Aluminum" Oct. 2001, vol. 104, No. 995.

"Chrome plating for preventing dragging" by OTEC.

Corresponding Chinese Appl. No. 201780030950.0, Chinese Office Action dated Mar. 19, 2020.

Corresponding European Appl. No. 17798914.2, European Search Report dated Mar. 17, 2020.

* cited by examiner (A)
before pre-treatment
(salt bath soft-nitriding)

(B)
after pre-treatment (A)
before pre-treatment
(ion nitriding)

(B)
after pre-treatment

METHOD FOR PREVENTING ADHESION OF ALUMINUM

FIELD OF THE INVENTION

The present invention relates to a method for preventing accumulation of aluminum and aluminum alloys (collectively referred to in the present specification as "aluminum"). The present invention particularly relates to a method for preventing accumulation of aluminum to jigs, tools, cutters, molds etc. ("processing tools" is the general term therefor) employed in aluminum processing or the like, and to a surface of metal articles such as the mold or the like that are used by being contacted with a workpiece made from aluminum when in use.

BACKGROUND OF THE INVENTION

Due to recent demands for weight reductions in vehicle bodies of cars and the like in order to reduce fuel consumption, as well as reducing weight by thinning thicknesses of materials by using high tensile steel, there are also now many occasions in which a reduction in weight is achieved by using aluminum materials. This has led to an accompanying increase in aluminum processing and molding work.

Due to such aluminum having a low melting point and being a soft material (having a high extensibility), it only takes a short period of time before aluminum accumulates to cutting edges of tools such as cutting tools and molds (die-casting, extrusion, forging, and press molds), and to processing tools employed by making sliding contact or press contact with aluminum workpieces. There is accordingly a need to perform work to replace processing tools, to remove accumulated aluminum, and the like. This leads to problems such as a fall in productivity and an increase in cost due to needing to interrupt production while this is being performed.

As methods to prevent such accumulation of aluminum, there are proposals to form a lubrication film made of diamond-like carbon (DLC) on mold surfaces and surfaces of cutting tools (Patent Document 1, Non-Patent Document 1).

Although not related to a method to prevent the accumulation of aluminum, the inventors of the present invention have already filed an application for a method of forming a surface strengthening film that is a method to strengthen the surface of a metal article. In this method, particles of tin, which have an oxide film formed thereon and have an average particle diameter of from 10 μm to 100 μm, are ejected at an ejection pressure of not less than 0.5 MPa or at an ejection velocity of not less than 200 m/sec against a product to be treated, so as to form a film of tin oxide having a thickness of not more than 1 μm on the surface of the treated product (Patent Document 2).

Note that a person of skill in the art knows that a combination of tin (Sn) and aluminum is a combination of metals for which accumulation occurs. Patent Document 3, listed below, focuses on accumulation characteristics of these two metals, and discloses a configuration in which tin (Sn) plating is performed on the surface of crimped terminals for use with aluminum wiring for the purpose of reducing electrical resistance (see claim 1 and claim 2 of Patent Document 3). Moreover, Non-Patent Document 2, listed below, discloses combinations of various metals with each other, and the combination of aluminum and tin is described as being a combination of metals that "readily melt into each other and seize to each other".

PRIOR ART

Patent Documents

[PATENT DOCUMENT 1] Japanese Unexamined Patent Application Publication No. 2013-163187

[PATENT DOCUMENT 2] Japanese Unexamined Patent Application Publication No. 2009-270176

[PATENT DOCUMENT 3] Japanese Unexamined Patent Application Publication No. 2009-176672

Non-Patent Documents

[Non-Patent Document 1] "DLC Tools to Implement Dry Processing of Aluminum" by Toru SEKIGUCHI, (Journal of the Japan Society of Mechanical Engineers 2001.10 Vol. 104, No. 995 page 60) https://www.jsme.or.jp/publish/kaisi/011002t.pdf

[Non-Patent Document 2] Paragraph on "Likelihood of seizure occurrences between different types of metal" in "Surface Treatment/Anti-Galling Chrome Plating" on the home page of Otec Co., Ltd. http://www.otec-kk.co.jp/surface/06.html.

SUMMARY OF THE INVENTION

Problems to be Solved by the Invention

For contact surfaces, when the surfaces of two metal articles are contacted at high pressure, oxide films that have formed on the two faces configuring the contact surfaces, or a fresh face on a surface exposed by breakdown of the oxide film on one face and the oxide film on the other face, or two such fresh faces, bond together at the atomic or molecular level.

Such bonding occurs significantly at protrusions in the surface roughness of the two faces. Such bonding not only occurs when there is no lubrication oil present between the two contact surfaces, but is also capable of arising at the boundaries of lubrication oil regions even when lubrication oil is present.

Fresh faces exposed by breakdown of a portion of a hard and brittle oxide film are extremely active. This means that when two faces in sliding contact are both fresh faces, then this results in strong bonding between the two, and is a cause of accumulation and seizure. This is common to such a situation, irrespective of the types of metal involved.

When the metals making sliding contact are iron or copper, as long as the surface of the processing tool contacting a fresh face of a workpiece has an oxide film formed thereon, the bonding force that arises between the two faces is not only weaker than the bonding force between two fresh faces, but is also weaker than the bonding force between two oxide films. Therefore, even if a fresh face is exposed on a face on one side, as long as no fresh face is exposed on the other face, then a large bonding force does not arise, and accumulation and seizure are not liable to occur.

Thus for cutting edges of cutting tools and molds made from iron (steel), accumulation can be suppressed from occurring by creating a state in which the exposure of a fresh face is not liable to occur, even when surfaces have been hardened to high hardness by nitriding treatment or the like and a high surface pressure applied.

However, when the material of at least one member is aluminum, the bonding force between a fresh face of aluminum and a surface oxide film, unlike with iron, causes stronger accumulation than the bonding force between two oxide films, and increases the difficulties in aluminum processing. This means that the accumulation of aluminum to the surface of processing tools cannot be sufficiently prevented even when performing processing so as not to expose fresh faces, such as by performing nitriding treatment or the like on the processing tools side.

As a result, when the workpiece is aluminum, the accumulation of aluminum to the surface of processing tools cannot be sufficiently prevented by merely performing surface strengthening treatment such as nitriding treatment. There is accordingly a need for further processing of the surface of processing tools to a state that has poor compatibility (accumulation properties) to aluminum in order to prevent the accumulation of aluminum.

In relation to this point, Patent Document 1 and Non-Patent Document 1 describe forming a DLC film on surfaces on the processing tool side, and utilizing the properties of DLC films that "due to terminal hydrogen on the surface thereof have high lubricity characteristics to alloys that have no carbon solid solubility" (see paragraph of Patent Document 1) in order to prevent accumulation of aluminum.

This means that in cutting tool and molds formed with a DLC film, the ability to prevent accumulation of aluminum is then also lost if the surface of the DLC film loses such a terminal hydrogen structure. For example, when the temperature of a mold is 300° C. or greater when processing at high processing efficiencies, hydrogen desorbs from the DLC film, and the terminal hydrogen structure on the surface is lost. This leads to the occurrence of accumulation and deposition on a workpiece (see paragraph [0005] of Patent Document 1).

Thus a configuration is adopted in Patent Document 1 in which, in order to prevent accumulation of aluminum due to loss of such a terminal hydrogen structure, cooling lubrication oil is ejected to cool the DLC film while processing a workpiece (see paragraph [0005] of Patent Document 1), or the temperature of the DLC film is stopped from rising to 300° C. or above by forming a flow channel for a cooling medium inside a mold and circulating the cooling medium (claim 1 of Patent Document 1). The configuration for cooling by ejection of cooling lubrication oil is costly due to the considerable quantity of cooling lubrication oil employed and then discarded. On the other hand, the structure of a mold is complicated by configurations formed with a cooling medium channel. A structure to circulate the cooling medium is also needed, and this results in a high cost of molds.

Moreover, when forming such DLC films, an expensive CVD device is required to form DLC films by performing vapor phase synthesis such as using a CVD method (see paragraphs [0003] and [0033] of Patent Document 1). This means that a high initial investment is required, and leads to a loss of price competitiveness in the market place due to the increased cost of products that results from passing on this high initial investment cost.

There is accordingly a desire for a proposal for a method capable of preventing aluminum from accumulating to metal articles such as processing tools and the like, with a method that is both simpler and employs simpler processing equipment.

Note that the inventors of the present invention have, as stated above, discovered that a tin oxide coating film having high hardness can be formed on the surface of an article to be treated by ejecting particles of tin having an oxide film formed thereon at a predetermined ejection pressure or predetermined ejection velocity. The inventors have already filed an application for a method for forming a surface strengthening film thereby (see Patent Document 2).

Even without being stated in Patent Document 3 and Non-Patent Document 2, a combination of tin (Sn) and aluminum is a combination of metals that causes accumulation (seizure), and a tin oxide coating film does not have a particular structure predicted to prevent accumulation of aluminum, such as the terminal hydrogen structure on the surface of a DLC film as described above. Thus, even if a tin oxide coating film was to be formed on the surface of a metal article, it would have been impossible to predict that an aluminum accumulation preventing effect would be exhibited thereby. Rather, the formation of a coating film of tin and tin oxide would actually have been postulated to aggravate the accumulation of aluminum.

In the above explanation, a case is described in which a processing tool such as a cutting tool, mold, or the like is subjected to treatment to prevent accumulation of aluminum. However, for metal articles other than processing tools, there is a common problem to prevent accumulation of aluminum and seizure etc. accompanying to the accumulation for metal articles that are caused to contact an aluminum metal article when in use, and preventing aluminum from accumulating is similarly desired for such metal articles. Examples include aluminum accumulating to iron and steel cylinders (sleeves) that make sliding contact with aluminum pistons and rotors, and preventing the seizure and immobilization of iron and steel bolts that have been screwed into aluminum engine blocks etc.

The present invention accordingly solves the deficiencies of the related technology described above. An object of the present invention is to provide an method for preventing accumulation of aluminum that is capable of preventing aluminum from accumulating to a surface of a metal article such as a cutting tool or the like at low cost and within a short period of time, by performing an extremely simple treatment of ejecting ejection particles.

Means to be Solved the Problems

In order to solve the problems, a method for preventing accumulation of aluminum according to the present invention is the method comprising:

ejecting tin particles against a metal article at an ejection pressure of not less than 0.5 MPa or at an ejection velocity of not less than 200 m/sec, the tin particles being formed with an oxide film on their surfaces and having an average particle diameter of from 10 μm to 100 μm; and forming a coating film of tin oxide having a thickness of not greater than 1 μm on a surface of the metal article at portions of the metal article to be contacted with aluminum or an aluminum alloy.

It is preferable in the above method for preventing accumulation of aluminum, the metal article is a metal article that has already been subjected to nitriding treatment.

It can be applied to be formed the tin oxide coating film after performing pre-treatment in which steel round shots of an average particle diameter of from 37 μm to 74 μm are ejected against the metal article at an ejection pressure of not less than 0.3 MPa or at an ejection velocity of not less than 100 m/sec. Alternatively, it may also be applied to be formed the tin oxide coating film after performing pre-treatment in which ceramic beads of an average particle diameter of from 38 μm to 90 μm are ejected against the metal article at an ejection pressure of not less than 0.2 MPa or at an ejection velocity of not less than 100 m/sec.

Note that both pre-treatments as described above i.e. the pre-treatment performed by ejecting steel round shots, and the pre-treatment performed by ejecting ceramic beads may be performed. In such cases, the pre-treatment performed by ejecting ceramic beads is preferably performed after performing the pre-treatment by ejecting steel round shots.

Effect of the Invention

According to the configuration of the present invention as described above, by applying the method for preventing accumulation of aluminum according to the present invention to the metal article, the accumulation of aluminum to the metal article subjected to the present invention can be prevented from being occurred even in a case where the metal article is contacted with an aluminum member at high surface pressure.

Performing one of various types of nitriding treatment, such as salt bath nitriding, salt bath soft-nitriding, gas nitriding, plasma nitriding, gas soft-nitriding, etc., on the metal article subject to treatment raises the strength of the layer underlying the tin oxide coating film. This makes the tin oxide coating film less susceptible to breaking down even when a high surface pressure is applied thereto, and enables the tin oxide coating film to be prevented from peeling off or the like, thereby enabling the effect for preventing accumulation of aluminum to be exhibited over a prolonged period of time.

In cases in which pre-treatment is performed by ejecting steel round shots and/or by ejecting ceramic beads against the surface of the metal article before forming the tin oxide coating film, any altered layer such as an oxide film or the like formed on the surface of the metal article is removed, the internal structure at the surface is micronized by a peening effect, the strength of the layer underlying the tin oxide coating film is raised, and the compressive residual stress is increased. This renders the tin oxide coating film less susceptible to peeing off or the like, and enables an improvement to be achieved in fatigue strength and the like.

In particular, in a configuration in which the pre-treatment described above is performed to the surface of the metal article after nitriding treatment, not only was removal of a layer of compounds on the nitride layer surface and micronization of the internal structure at the surface confirmed, nitrogen was also confirmed to have internally diffused to a greater extent, making the depth of the nitride layer deeper. This enables the adhesion strength of the tin oxide coating film formed in the subsequent process to be raised, and the tin oxide coating film to be made less susceptible to damage.

Note that when ejecting steel round shots made of high-speed tool steels or the like in the pre-treatment, the particle diameter of the steel round shots ejected is larger than that when ceramic beads such as alumina/silica or the like are employed. Although this enables an improvement in strength to be achieved deep inside the metal article, the surface of the metal article is roughened thereby. However, in the pre-treatment by ejecting the ceramic beads, although the increase in strength in the depth direction from the surface of the metal article is inferior to that when steel round shots are employed, the roughening of the metal article surface can be reduced. Accordingly, these pre-treatments are suitably selectable depending on the application.

Moreover, due to the characteristics of the two types of pre-treatment, when a composite type of pre-treatment is performed by ejecting the ceramic beads after ejecting the steel round shots, the pre-treatments for achieving an improvement in strength deep into the interior of the metal article by the ejection of the steel round shots, then ameliorating surface roughness by subsequently ejecting ceramic beads can also performed.

EMBODIMENT OF THE INVENTION

Figure 1:
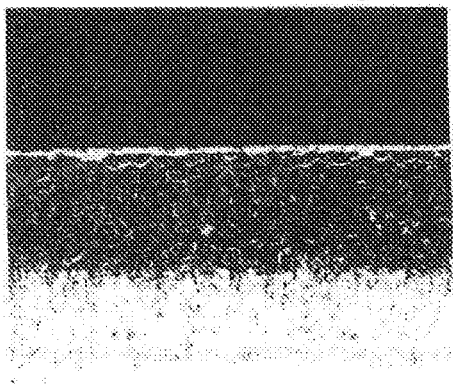
FIG. 1 are electromicrographs of cross-sections of a metal article to be treated in Example 1, and (A) is the metal article before pre-treatment, and (B) is the metal article after pre-treatment.
Figure 1:
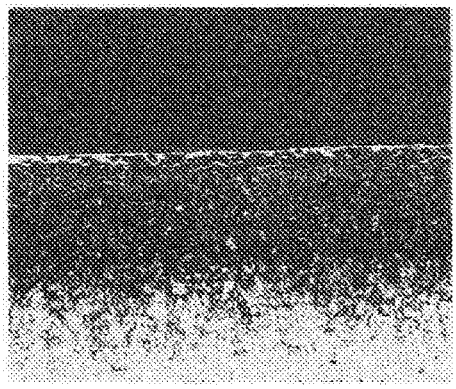

Next, explanation follows regarding an embodiment of the present invention, with reference to the appended drawings.

Outline of Method for Preventing Accumulation of Aluminum

A method for preventing accumulation of aluminum according to the present invention is a method including: ejecting tin particles against a metal article at an ejection pressure of not less than 0.5 MPa or at an ejection velocity of not less than 200 m/sec, the tin particles being formed with an oxide film on their surfaces and having an average particle diameter of from 10 μm to 100 μm, and preferably having an average particle diameter of from 20 μm to 50 μm; thereby forming a coating film of tin oxide with high adhesion strength having a thickness of not greater than 1 μm on a surface of the metal article at portions of the metal article intended to make contact with aluminum.

Ejection Particles

The method for preventing accumulation of aluminum according to the present invention employs tin particles formed with an oxide film on the surface thereof as ejection particles as described above. Such ejection particles may be obtained by, for example, manufacturing tin ejection particles using a water atomizing method.

A water atomizing method is a method to obtain particles by pulverization and instantaneous rapid solidification of molten tin by causing the molten tin to collide with high pressure water. The tin particles obtained in such a manner are particles of tin coated by an oxide film on the surface that results from surface oxidation due to rapid cooling when colliding with water.

The particle diameter of the ejection particles employed is an average particle diameter of from 10 μm to 100 μm, and preferably from 20 μm to 50 μm. In order to form a coating film on the surface of a metal article by being collided with the ejection particles, a temperature rise needs to be induced in the ejection particles by using the heat generated during collisions. This temperature rise is a rise proportional to the collision velocity of the ejection particles.

As long as the ejection particles have a particle diameter within the range stated above, the ejection particles are readily carried on an airflow generated by compressed gas employed during ejection. This enables the ejection particles to be collided against the surface of the metal article at high velocity, and is preferably performed to form a tin oxide coating film.

Note that the shape of the individual particles is not particularly limited for the ejection particles employed, and the shape thereof may be spherical, may be a polygonal shape, and may also be a mixture thereof.

Ejection Method

Various known blasting apparatuses for ejecting ejection particles together with a compressed gas such as compressed air may be employed to eject the ejection particles described above. There are no particular limitations to the ejection type of such blasting apparatuses, and any blasting apparatus capable of ejecting ejection particles at the ejection pressure or ejection velocity described above may be employed therefor, such as a blasting apparatus that uses a known method such as a direct type, gravity type, or suction type blasting apparatus.

The ejection particles are ejected at an ejection pressure of not less than 0.5 MPa or at an ejection velocity of not less than 200 m/sec. The temperature rise that occurs when ejection particles are collided against the surface of the metal article is proportional to the velocity of the ejection particles. The ejection particles accordingly need to be ejected at a high velocity in order to achieve favorable melting and adhesion of the ejection particles to the surface of the metal article.

In particular, the ejection particles employed in the method of the present invention have an oxide film formed on the surface thereof, and the melting point of an oxide film (tin oxide) is higher than that of tin (un-oxidized tin). The ejection particles accordingly need to be ejected at the above-stated high ejection pressure/ejection velocity.

Object to be Treated (Metal Article)

A metal article to be treated by the method for preventing accumulation of aluminum according to the present invention is a metal article that makes contact with aluminum when in use. Metal articles of various materials, shapes, and applications may be employed therefor as long as a tin oxide coating film can be formed thereon by ejecting such ejection particles at the above-stated ejection pressure or ejection velocity so as to be collided against the metal article. Examples include cutting edges of cutting tools used on aluminum materials, molds (die-casting, extrusion, forging, and press molds) used for molding aluminum, inner walls (sleeves) of cylinders employed in a state of sliding contact with pistons and/or rotors made from aluminum, fasteners and fixtures such bolts or the like that are screwed into aluminum members.

Preferably, a metal article that one of various types of nitriding treatment, such as salt bath nitriding, salt bath soft-nitriding, gas nitriding, plasma nitriding, gas soft-nitriding, etc., has been performed is employed as the metal article subject to treatment. More preferably, the metal article subject to treatment is more preferably an iron and steel product on which nitriding treatment has been performed.

Before forming the tin oxide coating film, pre-treatment may be performed by ejecting steel round shots of HSS steel or the like having an average particle diameter of from 37 μm to 74 μm against the metal article to be treated at an ejection pressure of not less than 0.3 MPa, or at an ejection velocity of not less than 100 m/sec. In place of such pre-treatment or after such pre-treatment, pre-treatment may be performed by ejecting ceramic beads such as alumina/silica beads or the like having an average particle diameter of from 20 μm to 63 μm against the metal article at an ejection pressure of not less than 0.2 MPa, or at an ejection velocity of not less than 100 m/sec.

Advantageous Effects Etc.

Due to performing the above, tin particles having an oxide film formed on the surface thereof and having an average particle diameter of from 10 μm to 100 μm, and preferably tin particles having an average particle diameter of from 20 μm to 50 μm, are ejected at not less than 0.5 MPa, or at a comparatively high velocity of an ejection velocity of not less than 200 m/sec, so as to be caused to collide against the surface of the metal article. The ejected tin particles are collided against the surface of the metal article, and, when the ejected tin particles are rebounded therefrom, a part of the ejected tin particles weld to the surface of the metal article, or diffuse/penetrate into or coat the metal article, forming the coating film of tin oxide.

When the tin particles are ejected at high velocity against the surface of the metal article with the above-stated ejection pressure and ejection velocity, thermal energy is generated by the tin particles changing velocity between before and after colliding with the surface of the metal article. This thermal energy only occurs at deformed portions which have been collided by the tin particles. This means that the temperature rise is localized to the tin particles and to the vicinity of the surface of the metal article where it has been collided by the tin particles.

Moreover, due to this temperature rise being proportional to the velocity of the tin particles before collision, the temperature of the tin particles and the surface of the metal article can be raised to a high temperature by using a high velocity for the tin particle ejection velocity. Due to the tin particles being heated at the surface of the metal article when this is being performed, oxidation is thought to occur at the raised temperature portions of the tin particles due to the temperature rise. Moreover, due to such a rise in temperature a part of the ejected particles, which include the oxide film formed on the ejection particle surface, are melt and accumulate to the surface of the metal article, or diffuse/penetrate into or coat the metal article to form the coating film.

At the same time, due to being collided by the ejection particles, effects are obtained such as those of surface processing heat treatment by shot peening. Thus, due to the residual stress etc. imparted when this occurs, both an increase in the fatigue strength of the metal article, and an accompanying increase in lifespan and the like, are achieved at the same time.

The mechanism by which forming the tin oxide coating film on the surface of the metal article enables the aluminum to be prevented from accumulating is not currently fully understood.

However, considering that a combination of tin and aluminum is thought to be a combination of metals for which accumulation and seizure occurs (Patent Document 1, Non-Patent Document 2), that the coating film formed by the method of the present invention is a coating film of tin oxide, rather than a coating film of tin, can be thought of as being a contributing factor to the prevention of accumulation.

It is thought that, due to accumulation occurring from bonding between atoms or bonding between molecules at contacting surfaces caused by the load imparted to the contact surfaces or frictional heat thereof, strong bonding readily occurs when materials having mutual affinity to each other are caused to make contact, or strong bond readily occurs when there is a combination of materials having high reactivity to each other. It is also thought that the lower the melting points of the respective metals, or the softer (the higher the extensibility) of the respective metals, the more readily mixing due to friction occurs therebetween.

Thus a tin oxide coating film is formed on the surface of the metal article in the method for preventing accumulation of aluminum according to the present invention, and this is a substance that, due to oxidation, is relatively chemically stable compared to tin itself. The surface energy of the tin oxide coating film is accordingly thought to be lower than the surface energy of a tin coating film.

Moreover, although tin has a low melting point of 232° C., the melting point of tin oxide is high at 1630° C. Tin oxide is accordingly not susceptible to softening due to heat produced under friction. Moreover, although as a metal tin is a soft metal having a Vickers hardness of about 5 kgf/mm$^2$, the oxide of tin, i.e. tin oxide, is a substance of high hardness, having a maximum Vickers hardness of about 1650 kgf/mm$^2$. The hardness of the tin oxide coating film formed in such a manner is a hardness that is accordingly equivalent to that of ceramics such as zirconia (about HV 1100 kgf/mm$^2$), alumina (about HV 1800 kgf/mm$^2$), silicon carbide (about HV 2200 kgf/mm$^2$), and aluminum nitride (about HV 1000 kgf/mm$^2$). This is thought to be why the tin oxide coating film is not liable to mix with the aluminum and to be a contributing factor to the prevention of accumulation and seizing.

Moreover, tin oxide coating films formed in this manner, and in particular tin oxide coating films formed after performing predetermined pre-treatment, have a high adhesion strength. This means that even in cases in which the tin oxide coating film is formed on portions that make sliding contact with other members under high loads, such as the cutting edge portions of cutting tools and sliding portions of mechanical components etc., the tin oxide coating film is not susceptible to peeling off or the like, and also exhibits a sufficient effect to prevent exposure of the base material (fresh faces).

Note that cases in which the surface of the metal article is rough are a cause of accumulation occurring due to aluminum, which is a soft metal, deforming into and clogging indentations formed in the surface. However, a configuration in which pre-treatment is performed by ejecting steel round shots and/or by ejecting ceramic beads before forming the tin oxide coating film, enables amelioration of the surface roughness of a metal article roughened by nitriding treatment or the like. This is also thought to be one reason why the accumulation of aluminum can be prevented.

The tin oxide coating film formed in this manner is not more than 1 μm, that is, extremely thin. This enables the shape of the metal article when the tin particles are being ejected and the shape of the final product to be shapes that are as close as possible to each other (what is referred to as "near net shapes"). This is advantageous from the perspective of not needing during design etc. to consider the film thickness of the coating film to be formed.

Explanation follows regarding Examples of various metal articles (molds) subjected to the method for preventing accumulation of aluminum of the present invention.

Treatment Conditions

The treatment conditions when the method for preventing accumulation of aluminum of the present invention were performed on Examples 1 to 5 are listed in Table 1 to Table 5, below.

Note that in the following Tables 1 to 5, the conditions under "pre-treatment" are for treatment performed before forming the tin oxide coating film, and the conditions under "main treatment" are for treatment performed when forming the tin oxide coating film. The "first process" and the "second process" in the "pre-treatment" indicate that a two stage treatment is performed, with the treatment of the second process being performed after the treatment of the first process.

TABLE 1

| Example 1 | | | | |
|---|---|---|---|---|
| Metal article subjected to treatment | | | Die-casting mold (salt bath soft-nitrided mold)<br>Material: SKD61<br>Base metal hardness: HRC48 (HV480)<br>Dimensions: 250 × 300 × 100t (mm)<br>Material to be molded: aluminum die-casting alloy (ADC12) | |
| Pre-treatment | Blasting apparatus | | First process: Direct type | Second process: Gravity type |
| | Ejection particles | | Spherical 150 grit HSS (44 μm to 125 μm) | Spherical 200 grit alumina/silica (63 μm to 90 μm) |
| | Ejection conditions | Ejection pressure | 0.5 MPa | 0.4 MPa |
| | | Ejection velocity | About 200 m/sec | About 200 m/sec |
| | | Nozzle diameter | φ 5 mm (long) | φ 9 mm (long) |
| | | Ejection distance | 200 mm | 150 mm |
| | | Ejection duration | About 10 minutes | About 10 minutes |
| Main treatment | Blasting apparatus | | Direct type | |
| | Ejection particles | | Substantially spherical 400 grit Sn (30 μm to 53 μm) | |
| | Ejection conditions | Ejection pressure | 0.5 MPa | |
| | | Ejection velocity | about 250 m/sec | |
| | | Nozzle diameter | φ 5 mm | |
| | | Ejection distance | 200 mm | |
| | | Ejection duration | About 10 minutes | |

TABLE 2

| Example 2 | | | | |
|---|---|---|---|---|
| Metal article subjected to treatment | | | Die-casting pin (ion nidrided pin)<br>Material: SKD61<br>Base metal hardness: HRC48 (HV480)<br>Dimensions: φ20 × 200L (mm) | |
| Pre-treatment | Blasting apparatus | | First process:<br>Direct type | Second process:<br>Gravity type |
| | Ejection particles | | Spherical 300 grit HSS<br>(37 μm to 74 μm) | Spherical 300 grit alumina/silica<br>(45 μm to 63 μm) |
| | Ejection conditions | Ejection pressure | 0.6 MPa | 0.4 MPa |
| | | Ejection velocity | About 200 m/sec | About 220 m/sec |
| | | Nozzle diameter | φ 9 mm (long) | φ 9 mm (long) |
| | | Ejection distance | 100 mm | 100 mm |
| | | Ejection duration | 60 seconds | 40 seconds |
| Main treatment | Blasting apparatus | | Gravity type | |
| | Ejection particles | | Substantially spherical 400 grit Sn<br>(30 μm to 53 μm) | |
| | Ejection conditions | Ejection pressure | 0.7 MPa | |
| | | Ejection velocity | about 250 m/sec | |
| | | Nozzle diameter | φ 9 mm (long) | |
| | | Ejection distance | 100 mm | |
| | | Ejection duration | About 40 seconds | |

TABLE 3

| EXAMPLE 3 | | | |
|---|---|---|---|
| Metal article subjected to treatment | | | Extrusion mold (wire cut processing: ion nitrided mold)<br>Material: SKD61<br>Base metal hardness: HRC48 (HV480)<br>Dimensions: 400 × 400 × 50t (mm)<br>Material to be molded: aluminum sash (A5052) |
| Pre-treatment | Blasting apparatus | | Gravity type |
| | Ejection particles | | Substantially spherical 300 grit alumina/silica<br>(45 μm to 63 μm) |
| | Ejection conditions | Ejection pressure | 0.4 MPa |
| | | Ejection velocity | about 220 m/sec |
| | | Nozzle diameter | φ 9 mm (long) |
| | | Ejection distance | 100 mm |
| | | Ejection duration | About 3 minutes |
| Main treatment | Blasting apparatus | | Gravity type |
| | Ejection particles | | Substantially spherical 400 grit Sn<br>(30 μm to 53 μm) |
| | Ejection conditions | Ejection pressure | 0.6 MPa |
| | | Ejection velocity | about 220 m/sec |
| | | Nozzle diameter | φ 9 mm (long) |
| | | Ejection distance | 100 mm |
| | | Ejection duration | About 5 minutes |

TABLE 4

| Example 4 | |
|---|---|
| Metal article subjected to treatment | Press mold (hardened and tempered/gas soft-nitrided mold)<br>Material: SKD61<br>Base metal hardness: HRC48 (HV480)<br>Dimensions: 150 × 500 × 100t (mm)<br>Material to be molded: aluminum frame (A5052) |

TABLE 4-continued

| Example 4 | | | | |
|---|---|---|---|---|
| Pre-treatment | Blasting apparatus | | First process: Direct type | Second process: Gravity type |
| | Ejection particles | | Spherical 400 grit HSS (30 μm to 53 μm) | Spherical 400 grit alumina/silica (38 μm to 53 μm) |
| | Ejection conditions | Ejection pressure | 0.5 MPa | 0.4 MPa |
| | | Ejection velocity | About 200 m/sec | About 240 m/sec |
| | | Nozzle diameter | φ 5 mm | φ 9 mm (long) |
| | | Ejection distance | 150 mm | 100 mm |
| | | Ejection duration | About 3 minutes | About 2 minutes |
| Main treatment | Blasting apparatus | | Direct type | |
| | Ejection particles | | Substantially spherical 400 grit Sn (30 μm to 53 μm) | |
| | Ejection conditions | Ejection pressure | 0.5 MPa | |
| | | Ejection velocity | 250 m/sec | |
| | | Nozzle diameter | φ 5 mm | |
| | | Ejection distance | 200 mm | |
| | | Ejection duration | About 3 minutes | |

TABLE 5

| Example 5 | | | |
|---|---|---|---|
| Metal article subjected to treatment | | | Die-casting pin (hardened and tempered/ion nitrided + TiAlN coated to about 3 μm) Material: SKD61 Base metal hardness: HRC48 (HV480) Dimensions: φ15 × 200L (mm) Material to be molded: aluminum die-casting alloy (ADC12) |
| Pre-treatment | Blasting apparatus | | Gravity type |
| | Ejection particles | | Spherical 400 grit alumina/silica (38 μm to 53 μm) |
| | Ejection conditions | Ejection pressure | 0.4 MPa |
| | | Ejection velocity | About 240 m/sec |
| | | Nozzle diameter | φ 9 mm (long) |
| | | Ejection distance | 100 mm |
| | | Ejection duration | About 30 seconds |
| Main treatment | Blasting apparatus | | Direct type |
| | Ejection particles | | Substantially spherical 400 grit Sn (30 μm to 53 μm) |
| | Ejection conditions | Ejection pressure | 0.7 MPa |
| | | Ejection velocity | about 250 m/sec |
| | | Nozzle diameter | φ 9 mm long |
| | | Ejection distance | 100 mm |
| | | Ejection duration | About 30 seconds |

Pre-Treatment Results (1) Treatment Results

Table 6 lists, for each of the metal articles subjected to the treatments of Examples 1 to 5, the changes in the surface hardness, the compressive residual stress, and surface roughness (each being about Ra 0.4 μm when mechanically processed) for the metal articles before pre-treatment (after nitriding treatment) and after the pre-treatment. Cross-sections were imaged for the metal articles subjected to the treatments of Example 1 and Example 2, electromicrographs of cross-sections of the metal articles taken before and after the pre-treatment, are illustrated in FIG. 1 (Example 1) and FIG. 2 (Example 2).

Figure 2:
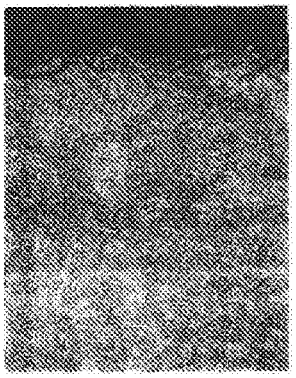
FIG. 2 are electromicrographs of cross-sections of a metal article to be treated in Example 2, and (A) is the metal article before pre-treatment, and (B) is the metal article after pre-treatment.
Figure 2:
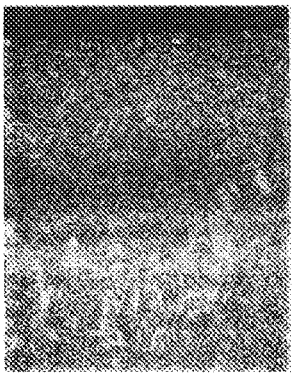

Note that in FIG. 1 and FIG. 2, (A) indicates the state before pre-treatment (i.e. the nitriding treated product) and (B) indicates the state after the pre-treatment.

TABLE 6

Hardness and Compressive Residual Stress Before and After Pre-Treatment

| | Hardness (Hv) | | Compressive residual stress (MPa) | | Surface Roughness Ra (μm) | |
|---|---|---|---|---|---|---|
| | Before pre-treatment | After pre-treatment | Before pre-treatment | After pre-treatment | Before pre-treatment | After pre-treatment |
| Example 1 | 1100 | 1250 | −600 | −1400 | 0.67 | 0.45 |
| Example 2 | 900 | 1200 | −500 | −1450 | 0.6 | 0.4 |
| Example 3 | 900 | 1200 | −600 | −1400 | 0.6 | 0.4 |
| Example 4 | 1000 | 1200 | −600 | −1400 | 0.68 | 0.46 |
| Example 5 | 2000 | 2000 | −600 | −1200 | 0.5 | 0.5 |

In each of the Examples 1 to 4, a layer of compounds formed on the nitride layer surface was removed by the pre-treatment, and the internal structure in the vicinity of the surface was micronized. The nitride layer in FIG. 1B also had a boundary with the base metal that was shifted downward in comparison to the state before pre-treatment of FIG. 1A, increasing the depth of the nitride layer. Namely, the nitriding due to internal diffusion was thought to have reached deeper portions.

Moreover, the surface hardness was raised and the compressive residual stress was increased by the pre-treatment of each of the Examples 1 to 4. Moreover, for the surface roughness, it was also confirmed that Examples that had become rough after nitriding treatment where ameliorated to a surface roughness close to that when mechanically processed.

Removal of the layer of compounds and the amelioration of the surface roughness referred to above is thought to result in a high adhesion strength being obtained by the tin oxide coating film formed in the subsequent processes. The hardness of the layer underlying the tin oxide coating film is thought to be raised by micronization of the surface structure. The spread of the nitride layer by internal diffusion of nitrogen is thought to result in a reduction in the hardness difference between the tin oxide coating film and the underlying layer, and in a situation in which deformation is not being liable to occur even if when bearing a high surface pressure. This is thought to enable cracking and breakdown of the tin oxide coating film to be prevented. Raising the fatigue strength by imparting compressive residual stress is thought to contribute to forming the tin oxide coating film that exhibits a high adhesion strength and exhibits an aluminum accumulation preventing effect over a prolonged period of time.

Note that although there were no changes observed in the hardness and surface roughness for Example 5 between before and after the pre-treatment, the compressive residual stress was raised to twice as much, and Example 5 was able to achieve greatly improved fatigue strength and the like of the metal article surface.

Durability Test

The results of a perpendicular pull-off adhesion strength test performed on the tin oxide coating film formed by the method of the present invention indicated a high numerical value of 20.7 kgf/cm$^2$ for adhesion strength. This confirmed that the tin oxide coating film was formed with high adhesion strength compared to a tin (Sn) plated layer formed by an electroplating method, which was easy to peel off.

Moreover, aluminum materials were molded using the metal articles of various types of mold having the tin oxide coating film formed thereon under the conditions explained for Examples 1 to 5. The results of the number of cycles (or for Example 3 and Comparative Example 3, which are extrusion molds, the weight of aluminum workpiece processed when seizure occurred) were measured until the end of the lifespan of the metal article, and are listed in Table 7.

Note that the Comparative Examples 1 to 5 in Table 7 below are for metal articles that had been subjected to only the pre-treatment under the treatment conditions indicated for the Example 1 to 5, and had not been subjected to the main treatment (formation of the tin oxide coating film).

TABLE 7

Durability Test Results

| | Type of metal article | Forming conditions | Lifespan | State at "end of lifespan" |
|---|---|---|---|---|
| Example 1 | Die-casting mold | Melting temperature 680° C. | 120,000 cycles | Erosion and heat cracking generated |
| Comparative Example 1 | | | 50,000 cycles | |
| Example 2 | Die-casting pin | Melting temperature 680° C. | 150,000 cycles | Seizure due to erosion |
| Comparative Example 2 | | | 75,000 cycles | |
| Example 3 | Extrusion mold | Extrusion temperature 450° C. | 9t | Seizure |
| Comparative Example 3 | | | 3t | |
| Example 4 | Press mold | Normal temperature | 75,000 cycles | Accumulation |
| Comparative Example 4 | | | 5,000 cycles | |
| Example 5 | Die-casting pin | Melting temperature 680° C. | 150,000 cycles | Erosion |
| Comparative Example 5 | | | 50,000 cycles | |

The above results confirmed that a significant advantageous effect was obtained for the molds that had been formed with the tin oxide coating film by the method of the present invention. Namely, aluminum accumulation was not liable to occur for these molds, and an improvement in lifespan was obtained of about 2 to 15 times that of the molds subjected to nitriding and pre-treatment alone (Comparative Examples 1 to 5).

What is claimed is:

1. A method for preventing accumulation of aluminum to a metal article to be contacted with aluminum or an aluminum alloy, the method comprising:

ejecting ejection particles consisting of tin particles against surfaces of the metal article at an ejection pressure of not less than 0.5 MPa or at an ejection velocity of not less than 200 m/sec, the tin particles having an oxide film formed on their surfaces and having an average particle diameter of from 10 μm to 100 μm; and forming a coating film of tin oxide having a thickness of not greater than 1 μm on a surface of the metal article at portions of the metal article to be contacted with aluminum or aluminum alloy.

2. The method for preventing accumulation of aluminum according to claim 1, wherein the tin oxide coating film is formed after performing pre-treatment in which steel round shots of an average particle diameter of from 37 μm to 74 μm are ejected against the metal article at an ejection pressure of not less than 0.3 MPa or at an ejection velocity of not less than 100 m/sec.

3. The method for preventing accumulation of aluminum according to claim 1, wherein the tin oxide coating film is formed after performing pre-treatment in which ceramic beads of an average particle diameter of from 38 μm to 90

μm are ejected against the metal article at an ejection pressure of not less than 0.2 MPa or at an ejection velocity of not less than 100 m/sec.

4. The method for preventing accumulation of aluminum according to claim 1, wherein the tin oxide coating film is formed after:

performing pre-treatment in which steel round shots having an average particle diameter of from 37 μm to 74 μm are ejected against the metal article at an ejection pressure of not less than 0.3 MPa or at an ejection velocity of not less than 100 m/sec; and also performing pre-treatment in which ceramic beads having an average particle diameter of from 38 μm to 90 μm are ejected against the metal article at an ejection pressure of not less than 0.2 MPa or at an ejection velocity of not less than 100 m/sec.

5. The method for preventing accumulation of aluminum according to claim 1, wherein the metal article is a metal article that has already been subjected to nitriding treatment.

6. The method for preventing accumulation of aluminum according to claim 5, wherein the tin oxide coating film is formed after performing pre-treatment in which steel round shots of an average particle diameter of from 37 μm to 74 μm are ejected against the metal article at an ejection pressure of not less than 0.3 MPa or at an ejection velocity of not less than 100 m/sec.

7. The method for preventing accumulation of aluminum according to claim 5, wherein the tin oxide coating film is formed after performing pre-treatment in which ceramic beads of an average particle diameter of from 38 μm to 90 μm are ejected against the metal article at an ejection pressure of not less than 0.2 MPa or at an ejection velocity of not less than 100 m/sec.

8. The method for preventing accumulation of aluminum according to claim 5, wherein the tin oxide coating film is formed after:

performing pre-treatment in which steel round shots having an average particle diameter of from 37 μm to 74 μm are ejected against the metal article at an ejection pressure of not less than 0.3 MPa or at an ejection velocity of not less than 100 m/sec; and also performing pre-treatment in which ceramic beads having an average particle diameter of from 38 μm to 90 μm are ejected against the metal article at an ejection pressure of not less than 0.2 MPa or at an ejection velocity of not less than 100 m/sec.

* * * * *